US005778339A

United States Patent [19]

Sonohara et al.

[11] Patent Number: 5,778,339

[45] Date of Patent: Jul. 7, 1998

[54] SIGNAL ENCODING METHOD, SIGNAL ENCODING APPARATUS, SIGNAL DECODING METHOD, SIGNAL DECODING APPARATUS, AND RECORDING MEDIUM

[75] Inventors: Mito Sonohara; Kyoya Tsutsui, both of Kanagawa; Robert Heddle, Tokyo, all of Japan

[73] Assignee: Sony Corporation, Tokyo, Japan

[21] Appl. No.: 491,948

[22] PCT Filed: Nov. 29, 1994

[86] PCT No.: PCT/JP94/02004

§ 371 Date: Jul. 18, 1995

§ 102(e) Date: Jul. 18, 1995

[87] PCT Pub. No.: WO95/14990

PCT Pub. Date: Jun. 1, 1995

[30] Foreign Application Priority Data

Nov. 29, 1993 [JP] Japan ..... 5-298305

[51] Int. Cl.[6] ..... G10L 3/02; G10L 9/00

[52] U.S. Cl. ..... 704/224; 704/224; 704/230

[58] Field of Search ..... 395/2.33, 2.38, 395/2.39, 2.91; 704/224, 229, 230, 500

[56] References Cited

U.S. PATENT DOCUMENTS

| | | | |
|---|---|---|---|
| 4,541,012 | 9/1985 | Tescher | 358/133 |
| 4,896,362 | 1/1990 | Veldhuis et al. . | |
| 4,949,383 | 8/1990 | Koh et al. | 395/2.33 |
| 5,105,463 | 4/1992 | Veldhuis et al. . | |
| 5,241,535 | 8/1993 | Yoshikawa | 370/60 |
| 5,301,205 | 4/1994 | Tsutsui et al. | 395/2.91 |
| 5,367,608 | 11/1994 | Veldhuis et al. | 395/2.38 |
| 5,414,795 | 5/1995 | Tsutsui et al. | 395/2.13 |
| 5,566,154 | 10/1996 | Suzuki | 395/2.38 |

FOREIGN PATENT DOCUMENTS

| | | | |
|---|---|---|---|
| 58-145999 | 8/1983 | Japan | G10L 1/00 |
| 62-278598 | 12/1987 | Japan | G10L 7/04 |
| 63-70299 | 3/1988 | Japan | G10L 7/04 |
| 0 289 080 | 4/1988 | Japan | H04B 1/66 |
| 63-285032 | 11/1988 | Japan | H04B 14/04 |
| 2-501507 | 5/1990 | Japan | G10L 9/18 |
| 5-313694 | 11/1993 | Japan | G10L 7/04 |

OTHER PUBLICATIONS

Hans Georg Musmnn, "The ISO Coding Standard", GLOBECOM '90, IEEE, pp. 511–517.

*Primary Examiner*—Allen R. MacDonald
*Assistant Examiner*—Patrick N. Edward
*Attorney, Agent, or Firm*—Limbach & Limbach LLP; Seong-Kun Oh

[57] ABSTRACT

In this invention, an approach is employed to carry out blocking of an input signal to transform the blocked signals into spectrum signals to divide the spectrum signals into a plurality of units to normalize them thereafter to implement variable length encoding to all or a portion of the spectrum signals to output the variable-length encoded signals along with normalization coefficient and the number of re-quantization bits of each unit, wherein an upper limit is provided with respect to the number of bits per each block of a signal to be encoded and outputted to compulsorily change, in a block for which the number of bits above the upper limit is required, normalization coefficient of at least one unit thereafter to re-quantize and entropy-encode a corresponding signal to output the encoded spectrum signal, thereby permitting hardware scale to be smaller as compared to the conventional apparatus without depending upon unevenness of the number of bits by variable length encoding. In addition, efficient encoding and decoding can be carried out in a form such that influence from a viewpoint of the hearing sense is small.

65 Claims, 7 Drawing Sheets

SIGNAL ENCODING METHOD, SIGNAL ENCODING APPARATUS, SIGNAL DECODING METHOD, SIGNAL DECODING APPARATUS, AND RECORDING MEDIUM

TECHNICAL FIELD

This invention relates to a signal encoding method and a signal encoding apparatus for encoding digital signals such as speech, audio or picture signals, etc., a signal decoding method and a signal decoding apparatus for decoding such encoded signal, and a recording medium adapted so that which such encoded signals are recorded therein.

BACKGROUND ART

As a sort of efficient encoding techniques for efficiently carrying out bit compression of time series sample data signals such as audio signals, etc. to encode them, transform encoding using so called spectrum transform processing is known. This transform encoding carries out spectrum transform processing of input signals in block units to encode them. As the representative of this spectrum transform processing, Discrete Cosine Transform (DCT) processing is known.

In such transform encoding, a block distortion such that discontinuous connection (joint) portions between blocks are perceived as noise is in question. To lessen such a block distortion, a method of allowing the end portion of a block to overlap with the adjacent blocks is generally carried out.

In the case of the so called Modified Discrete Cosine Transform (MDCT), since there is employed an approach in which, while allowing an arbitrary block and blocks adjoining in both directions to overlap with each other respectively by halves (half blocks), no double transmission is carried out with respect to samples of the overlap portions, MDCT is suitable for efficient encoding.

Encoding and decoding using such MDCT and IMDCT which is the inverse transform processing thereof are disclosed in, e.g., Mochizuki, Yano, Nishitani "Filter Constraint of Plural Block Size Mixed MDCT", Technical Report of the Institute of Electronics and Communication Engineers of Japan, CAS 90-10, DSP 90-14, pp. 55–60, or Hazu, Sugiyama, Iwatare, Nishitani "Adaptive Block Length Adaptive Transform Coding using MDCT (ATC-ABS)", Institute of Electronics and Information Engineers of Japan, Spring General Meeting Lecture Collection (1990), A-197, etc. Such encoding and decoding will be briefly described below with reference to FIG. 1.

In FIG. 1, an arbitrary block, e.g., the J-th block of time series sample data overlaps with the (J−1)-th block and the (J+1)-th block by halves (50%). When the number of samples of the J-th block is assumed to be N (N is natural number), the J-th block has overlap portion of N/2 number of samples between the J-th block and the (J−1) block, and also has overlap portion of N/2 samples between the J-th block and the (J+1)-th block. Pre-processing filter or window Wh for transform processing is applied to samples of these respective blocks, e.g., arbitrary input time series sample 101 of the J-th block to obtain N number of time series data 102.

As the characteristic of a pre-processing filter or the window Wh for transform processing, the degree of power concentration of data obtained by the transform processing becomes highest is selected in correspondence with the statistical property of an input signal. Then, linear transform processing of MDCT is implemented to time series data 102 of N samples, whereby N/2 number of independent spectrum data 103 on the frequency base which is one half of the number of input samples are obtained. Linear inverse transform processing of IMDCT is implemented to the N/2 number of spectrum data 103 to thereby obtain (reproduce) N number of time series data 104. Synthesis filter or window Wf for inverse transform processing is applied to the time series data 104 to obtain time series data 105 thereafter to add it to output results of blocks before and after thus to restore (reconstruct) original input time series sample data.

In the conventional efficient encoding, there has been employed a method of dividing spectrum data 103 obtained in a manner as described above into several units, at every band, to normalize data at each respective units, and to re-quantize data by taking the characteristic from a viewpoint of the hearing sense into consideration to output the re-quantized spectrum data 103 along with normalization coefficients of respective units. Moreover, as occasion demands, outputted spectrum data 103 is recorded onto a recording medium, or is transmitted to an efficient decoding apparatus through a transmission path.

In addition to the above, in the conventional efficient encoding, as indicated by the ISO standard ISO 11172-3, such an entropy encoding to allocate codes in accordance with occurrence frequency, e.g., to allocate shorter codes to data of higher frequency and to allocate longer codes to data of lower frequency has been implemented to all or a portion of these spectrum data to thereby allow efficiency to be higher.

However, in the case where such an entropy encoding is implemented, required numbers of bits are changed (variable) for every respective block of time series sample data, and upper limit of the numbers of bits cannot be recognized until an input signal is actually encoded. For this reason, not only are encoding and decoding at a fixed bit rate difficult, but also scale of hardware is enlarged.

DISCLOSURE OF THE INVENTION

This invention has been made in view of the actual circumstances as described above, and an object of this invention is to provide a signal encoding method and a signal encoding apparatus which permits scale of hardware to be smaller than the conventional apparatus without depending upon unevenness of the number of bits by variable length encoding, and which can realize more efficient encoding in a form such that influence from a viewpoint of the hearing sense is small, a signal decoding method and a signal decoding apparatus corresponding to such encoding method/apparatus, and a recording medium adapted so that signals encoded by such encoding method/apparatus are recorded therein.

To achieve such an object, a signal encoding method according to this invention comprises the steps of: blocking an input signal (dividing an input signal into blocks) to transform these block (or blocked) signals (signals every blocks) into spectrum signals; dividing the spectrum signals into a plurality of units to normalize them; implementing variable length encoding to all or a portion of the spectrum signals; and outputting the variable length-encoded signal or signals along with normalization coefficient and No. of re-quantization bits of each unit, wherein an upper limit is provided with respect to the number of bits per each block of the signal to be encoded and outputted, and wherein, in a block for which the number of bits above the upper limit is required, normalization coefficient of at least one unit is compulsorily changed thereafter to re-quantize and entropy-encode a corresponding spectrum signal to output the re-quantized and entropy-encoded spectrum signal.

Moreover, a signal encoding apparatus according to this invention comprises: transform means for blocking an input signal to transform these block signals into spectrum signals; normalizing means for dividing the spectrum signals into a plurality of units to normalize them; and variable length encoding means for implementing variable length encoding to all or a portion of the spectrum signals, thus to implement variable length encoding to all or a portion of the spectrum signals to output the variable length encoded signal along with normalization coefficient and No. of re-quantization bits of each unit, wherein the apparatus comprises: upper limit setting means for providing (setting) an upper limit with respect to the number of bits per each block of the signal to be encoded and outputted, and normalization coefficient compulsorily changing means for detecting a block for which the number of bits above the upper limit is required to compulsorily change normalization coefficient of at least one unit in the detected block, thus to compulsorily change normalization coefficient of at least one unit within the block for which the number of bits above the upper limit is required thereafter to re-quantize and entropy-encode a corresponding spectrum signal to output the re-quantized and entropy-encoded spectrum signal.

In the signal encoding method and the signal encoding apparatus according to this invention, in dividing spectrum signals into units within a corresponding one of respective blocks, the number of units within each block and the number of spectrum signals within each unit change in dependency upon shape of spectrum signals of the corresponding block. Further, in dividing spectrum signals into units within each block, the spectrum signals are separated into spectrum signals of tone characteristic and spectrum signals of noise characteristic to divide the spectrum signals of tone characteristic or the spectrum signals of noise characteristic into a different single unit or plural units to output information indicative of division of the unit.

Moreover, in the signal encoding method and the signal encoding apparatus according to this invention, in a block for which the number of bits above the upper limit is required, selection of unit in which the normalization coefficient is caused to be changed is carried out in dependency upon the shape of spectrum signals of the block. Further, normalization coefficient of at least one unit is caused to have a larger value. Moreover, selection is made in the order from units in which normalization coefficient is small to allow the selected unit to have a larger normalization coefficient. Further, selection of unit in which normalization coefficient is caused to have a larger value is made in the order from units of higher frequency band side of all spectrum signals. Moreover, there is employed an approach in which normalization coefficient of a portion of units is not caused to be changed to make a selection in the order from units in which normalization coefficient is small of the remaining units to allow normalization coefficient of the selected unit to have a larger value. In addition, there is employed an approach in which normalization coefficients of a unit of spectrum signals of tone characteristic are not caused to be changed to make a selection in the order from units in which normalization coefficient is small of the remaining units to allow normalization coefficient of the selected unit to have a larger value.

Further, in the signal encoding method and the signal encoding apparatus according to this invention, the input signal is divided into signals in plural bands having respective bandwidths which are not uniform to carry out transform processing into spectrum signals at every respective band.

Further, in the signal encoding method and the signal encoding apparatus according to this invention, Modified Discrete Cosine Transform processing (technique) is used as the transform processing from the input signal to spectrum signals.

Further, in the signal encoding method and the signal encoding apparatus according to this invention, a plurality of code tables of variable length codes used in the variable length encoding are prepared in correspondence with the number of bits of re-quantization to carry out variable length encoding by using the plurality of code tables. In addition, a plurality of code tables of variable length codes used in the variable length encoding are prepared to select a code table in which the number of bits required for encoding is minimum in each block to carry out variable length encoding by using the selected code table, and to output an identification signal of the selected code table.

A signal decoding method and a signal decoding apparatus according to the invention are adapted to decode signals encoded by the signal encoding method or the signal encoding apparatus according to this invention.

A recording medium according to this invention is adapted so that signals encoded by the signal encoding method or the signal encoding apparatus according to this invention are recorded therein.

In accordance with this invention, an upper limit of the number of bits after undergone encoding is determined with respect to each block of an input signal. In a block or blocks for which the number of bits above the upper limit is required, normalization coefficients of respective units are adjusted to thereby fix upper limit of the number of bits required. Thus, not only processing at a fixed bit rate can be made, but also scale of hardware can be held down to a certain (predetermined) scale even at a variable bit rate.

Further, in accordance with this invention, an approach is employed to extract, as a tone characteristic component, adjacent several spectrum components in which energies concentrate of spectrum signals of respective blocks to allow the respective extracted spectrum signals to be units and to allow spectrum signals except for the above to be noise characteristic components to divide them every bands set in advance to allow such divided components to be units. In a block or blocks for which the number of bits above the upper limit is required, an operation to compulsorily allow normalization coefficients of respective units to have a larger value in reverse order of magnitude of normalization coefficient only with respect to units of noise characteristic components of units divided in this way, and in order from the side of higher frequency band in the case of the same normalization coefficient is repeated until the number of bits does not exceed the upper limit, thereby permitting the influence from a viewpoint of the hearing sense to be as minimum as possible.

Further, in noise characteristic components where no energy does not concentrate, such noise components frequently take 0 (zero) particularly as spectrum data after undergone re-quantization, and relatively short codes are allocated to 0 of spectrum data in the entropy encoding. Accordingly, since an approach is employed in this invention to allow normalization coefficients to compulsorily have a larger value so that several spectrum data which have not been zero until that time become equal to 0 thus to permit those bits to be expressed by lesser number of bits, it becomes possible to reduce, by a procedure as described above, the number of bits required in a form such that influence from a viewpoint of the hearing sense is small.

Furthermore, setting of upper limit of the number of bits is carried out in plural block units of time series sample data, or a plurality of code tables are prepared in the entropy encoding to select, every block, a code table in which the number of bits required is minimum. Thus, encoding of high compression efficiency can be carried out. In addition, a plurality of other methods can be combined.

BEST MODE FOR CARRYING OUT THE INVENTION

Preferred embodiments of a signal encoding method, a signal encoding apparatus, a signal decoding method, a signal decoding apparatus, and a recording medium according to this invention will now be described with reference to the attached drawings.

Figure 2:
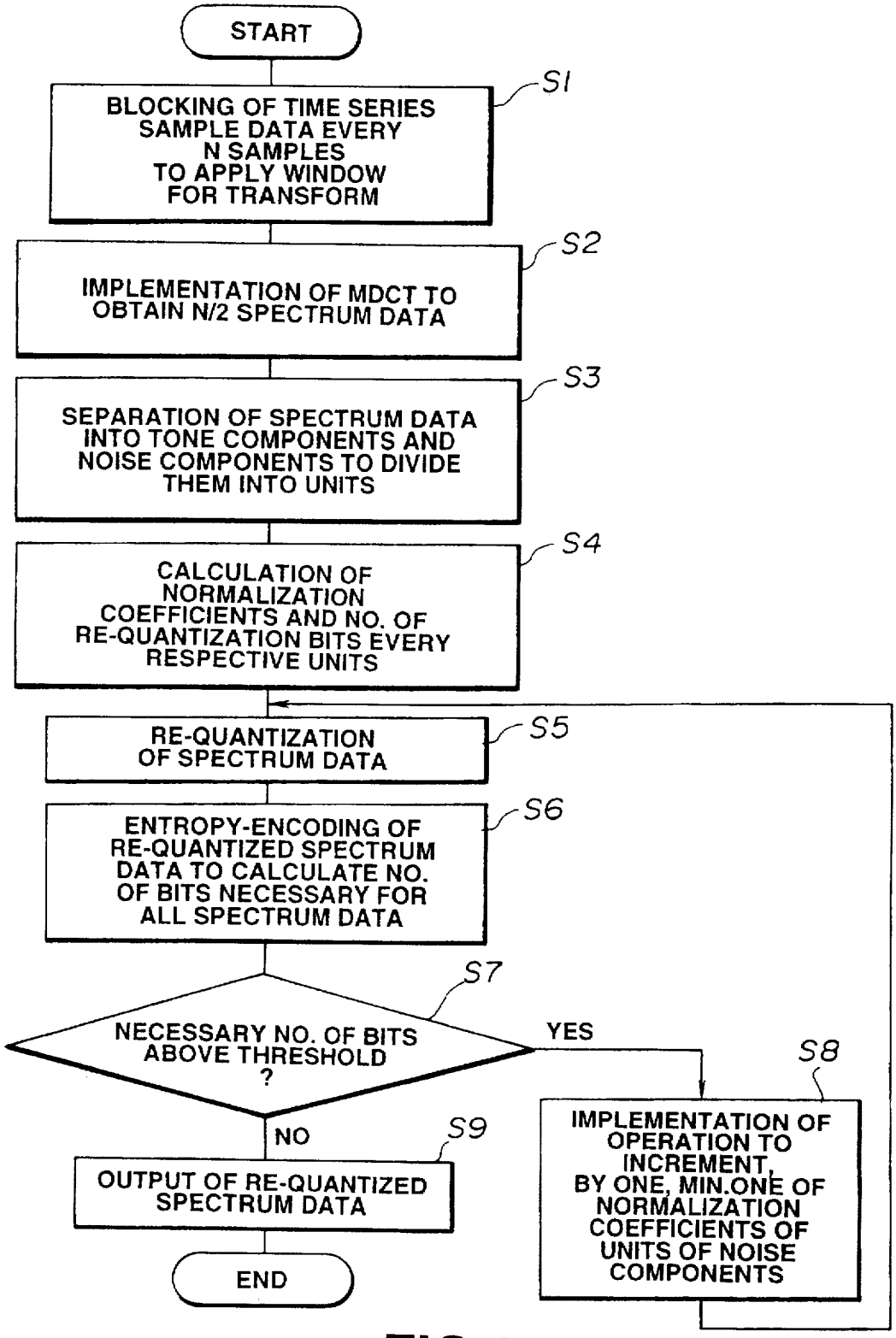
FIG. 2 is a flowchart of an embodiment of a signal encoding method according to this invention.

The flowchart of FIG. 2 shows outline of the procedure of signal encoding in the embodiment of the signal encoding method according to this invention.

Namely, the signal encoding method of this embodiment comprises the steps of: blocking an input signal into blocks to transform block signals (every block of the input signal) into spectrum signals; dividing these spectrum signals into a plurality of units to normalize them; implementing variable length encoding to all or a portion of the spectrum signals; and outputting the signals thus obtained along with normalization coefficients and the numbers of re-quantization bits of respective units. In addition, such outputted signals are recorded onto or into recording media, e.g., magnetic tape, optical disc, magneto-optical disc, phase change type optical disc, semiconductor memory and/or so called IC card, etc., or are transmitted, through a transmission path, to a signal decoding apparatus adapted for decoding encoded signals.

Moreover, in the signal encoding method of this embodiment, an upper limit is provided with respect to the number of bits per each block of signals which are encoded, outputted, and recorded or transmitted to compulsorily change, in a block or blocks for which the number of bits above the upper limit is required, normalization coefficient of at least one unit thereafter to re-quantize and entropy-encode spectrum signals to output the entropy encoded spectrum signals to thereby allow the number of bits per each block of a signal to be outputted not to exceed the number of bits of the upper limit.

Figure 1:
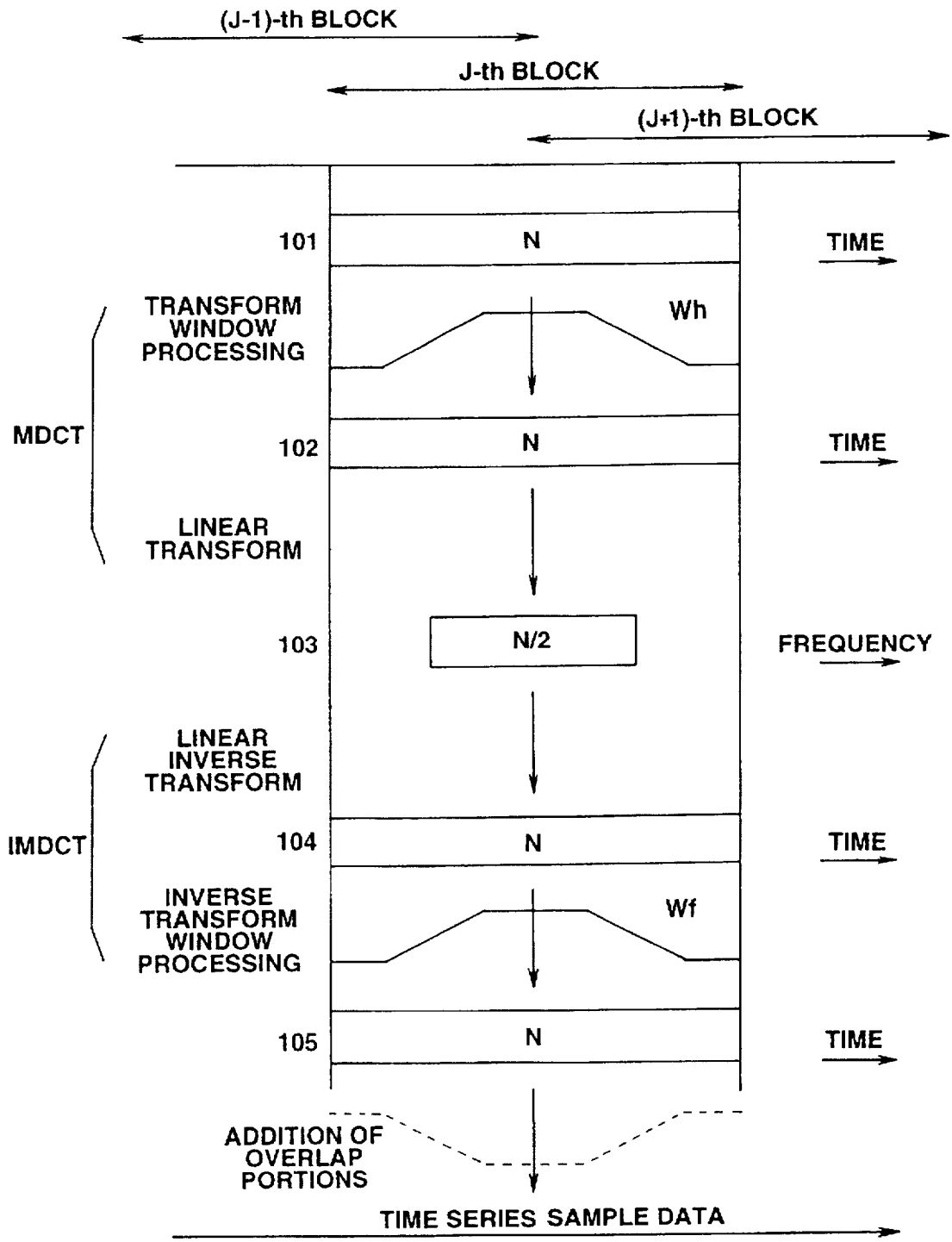
FIG. 1 is a view for explaining outline of processing procedure of MDCT and IMDCT which is inverse transform processing thereof.

In a more practical sense, at step S1 shown in FIG. 2, time series sample data, e.g., PCM audio data, etc., is caused to undergo blocking so that the respective overlap quantities between a corresponding block and adjacent blocks become equal to 50%, i.e., they overlap with each other by N/2 samples for every predetermined number of samples (e.g., N samples) and as shown in FIG. 1 and window Wh for transform processing is applied to a sample data of the J-th block of the time series data.

Then, at step S2, MDCT is implemented to the sample data to which window Wh for transform processing has been applied to obtain N/2 number of spectrum data.

At step S3, separation of spectrum data is carried out such that spectrum data having energy concentration are caused to be respectively units as tone characteristic component, and the remaining spectrum data are caused to be units set in advance as noise characteristic component.

At step S4, normalization coefficients and the numbers of re-quantization bits necessary for normalizing spectrum data of the tone characteristic component and the noise characteristic component are calculated for every respective units.

At step S5, the normalization coefficients and the numbers of re-quantization bits determined for every respective units are used to carry out normalization and re-quantization of the respective spectrum data.

At step S6, entropy-encoding is implemented to the re-quantized spectrum data to calculate the number of bits necessary for a corresponding block as a whole.

At step S7, judgment as to whether or not the number of bits necessary for this block is above an upper limit set in advance (hereinafter referred to as threshold) is carried out. In the case where the number of bits is above the threshold, processing operation proceeds to step S8. In the case where the number of bits is not above the threshold, the processing operation proceeds to step S9.

At step S8, an operation to increment, by one, minimum one of normalization coefficients of units of, e.g., noise characteristic components is implemented. The processing returns to the step S5.

On the other hand, at step S9, re-quantized and entropy-encoded spectrum data is outputted. Thus, the processing is completed.

It should be noted that, at step S8 mentioned above, for the purpose of allowing influence from a viewpoint of the hearing sense to be smaller, only normalization coefficient of a unit having the minimum normalization coefficient and the highest frequency band of, e.g., noise component may be increased.

Figure 3:
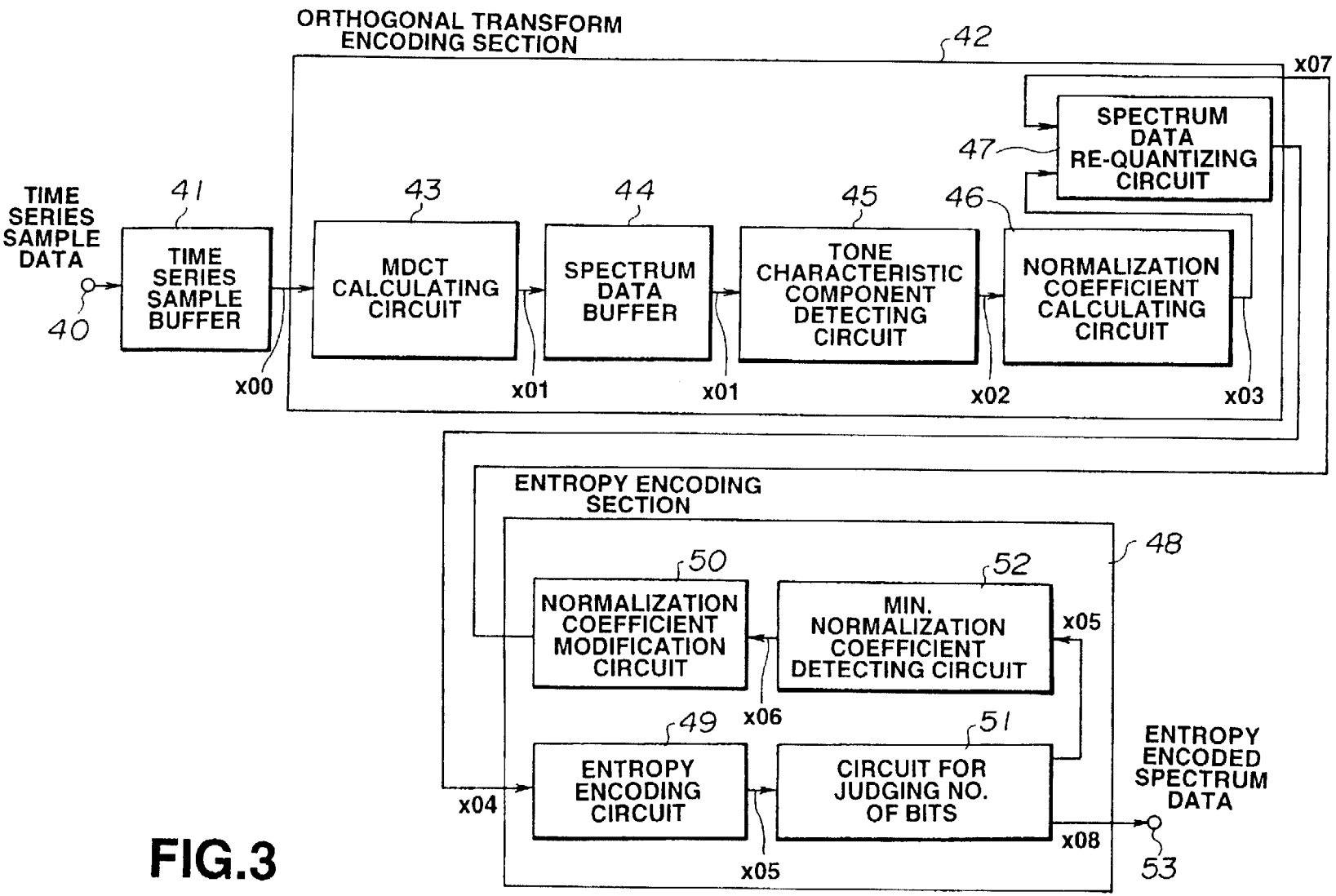
FIG. 3 is a block circuit diagram showing an embodiment of a signal encoding apparatus according to this invention.

Hardware for realizing the above-described signal encoding method, i.e., an example of the configuration of a signal encoding apparatus to which this invention is applied is shown in FIG. 3.

The signal encoding apparatus to which this invention is applied includes, as shown in FIG. 3, a time series sample buffer 41 for blocking an input signal, an orthogonal transform encoding section 42 for transforming the blocked signals from the time series sample buffer 41 into spectrum signals, and for dividing the spectrum signals into a plurality of units to normalize them, and an entropy-encoding section 48 for implementing variable length encoding to all or a portion of the spectrum signals from the orthogonal transform encoding section 42.

This signal encoding apparatus is adapted to implement variable length encoding to all or a portion of the spectrum signals to output the variable length-encoded spectrum signals along with normalization coefficients and the numbers of re-quantization bits of respective units. In addition, these outputted signals are recorded onto a recording medium, e.g., magneto-optical disc, etc., or are transmitted to a signal decoding apparatus which will be described later.

Further, the signal encoding apparatus is adapted so that when the number of bits per each block of a signal encoded and outputted is above the number of bits of the upper limit set in advance, normalization coefficient of at least one unit is compulsorily changed in a block for which the number of bits above the upper limit is required thereafter to re-quantize and entropy-encode a corresponding spectrum signal to output the spectrum signal to thereby allow the number of bits per each block of a signal to be outputted not to exceed the number of bits of the upper limit.

In a more practical sense, in FIG. 3, time series sample data delivered through input terminal 40 is stored into the time series sample buffer 41. The time series sample data stored in the time series sample buffer 41 is read out in block units consisting of N sample data, and is delivered to the orthogonal transform encoding section 42 as data x00.

The orthogonal transform encoding section 42 comprises, as shown in FIG. 3 mentioned above, a MDCT calculating circuit 43 for transforming data x00 from the time series sample buffer 41 into spectrum signals, a spectrum data buffer 44 for dividing the spectrum signals from the MDCT calculating circuit 43 into a plurality of units, a tone characteristic component detecting circuit 45 for detecting tone characteristic component of the spectrum signals stored in the spectrum data buffer 44, a normalization coefficient calculating circuit 46 for normalizing, at every unit, the spectrum signals delivered through the tone characteristic component detecting circuit 45, and a spectrum data re-quantizing circuit 47 for re-quantizing spectrum components normalized at the normalization coefficient calculating circuit 46.

The MDCT calculating circuit 43 applies window for transform processing to data x00 from the time series sample buffer 41, i.e., time series sample data of block unit, and implements MDCT thereto to generate N/2 number of spectrum data to deliver the spectrum data as data x01 to the spectrum data buffer 44. The data x01 thus obtained is stored into the spectrum data buffer 44, and is then read out therefrom. The data thus read out is sent to the tone characteristic component detecting circuit 45.

The tone characteristic component detecting circuit 45 divides the spectrum data x01 delivered from the spectrum data buffer 44 into units set in advance so as to extract spectrum components of the spectrum data x01 having energy concentration to allow the extracted components to be tone characteristic components and to allow the remaining components to be noise characteristic components and to deliver, to the normalization coefficient calculating circuit 46, the divided spectrum data as data x02 along with division information of that unit. In actual terms, the above-described separation between tone characteristic components and noise characteristic components is carried out, e.g., in dependency upon shape of spectrum data of respective blocks. Further, the number of spectrum data which serve as tone characteristic component may be variable. In addition, division information of units, e.g., the number of spectrum components of tone characteristic or position information of spectrum components are also encoded and outputted in a manner as described later.

The normalization coefficient calculating circuit 46 calculates normalization coefficients and the numbers of re-quantization bits such that influence from a viewpoint of the hearing sense becomes minimum with respect to respective units of data x02 to deliver, as data x03 along with data x02, to the spectrum data re-quantizing circuit 47, the normalization coefficient and the number of re-quantization bits of each unit which have been thus obtained. In actual terms, the calculation of normalization coefficient and number of re-quantization bits is carried out, e.g., in dependency upon shape of spectrum (spectrum components) of block so that influence from a viewpoint of the hearing sense becomes minimum.

The spectrum data re-quantizing circuit 47 normalizes, for every unit, spectrum data of data x03 by using normalization coefficients of every respective unit of data x03 from the normalization coefficient calculating circuit 46, and re-quantizes those data to deliver the re-quantized spectrum data as data x04 to an entropy encoding section 48.

The entropy encoding section 48 comprises, as shown in the FIG. 3, an entropy encoding circuit 49 for entropy-encoding data x04 from the spectrum data re-quantizing circuit 47, a circuit 51 for judging number of bits, which serves to judge whether or not the number of bits per each block of a signal to be encoded and outputted is above the upper limit, a minimum normalization coefficient detecting circuit 52, and a normalization coefficient modification circuit 50 for compulsorily changing normalization coefficient of at least one unit in a block for which the number of bits above the upper limit set at the bit No. judging circuit 51 is required.

The entropy encoding circuit 49 entropy-encodes data x04, i.e., N/2 number of spectrum data which have been re-quantized by using, e.g., a code table for entropy encoding, to deliver, to the bit No. judging circuit 51, the entropy-encoded spectrum data as data x05 along with the number of bits necessary for each unit. In this instance, entropy encoding is carried out with respect to, e.g., all of the spectrum data of the unit. Alternatively, entropy encoding is carried out with respect to, e.g., a portion of spectrum data. In this case, for example, entropy encoding is implemented only to the spectrum data of noise characteristic components, and no entropy encoding is implemented to the tone characteristic components. Moreover, e.g., a plurality of code tables for entropy encoding may be provided to select, for every block, a code table in which the number of bits required becomes minimum to carry out entropy encoding by using the selected code table, thus to carry out more efficiently variable length encoding as compared to the case where one code table is used. In this case, identification information (ID) for identifying a selected code table is caused to be outputted together.

The bit No. judging circuit 51 calculates the sum total of the numbers of bits required for the respective units of one block to determine the numbers of bits required for the respective blocks to judge whether or not each number of bits is above the threshold set in advance. In the case where the required number of bits is above the threshold, data x05 is delivered to the minimum normalization coefficient detecting circuit 52. On the other hand, in the case where the required bit number is not above the threshold, data x05, i.e., entropy encoded spectrum data, normalization coefficients of respective units, the number of re-quantization bit and division information of the units are outputted from a terminal 53 as data x08. This outputted data x08 is recorded onto a recording medium, e.g., package media, e.g., or is transmitted to a signal decoding apparatus through, e.g., a transmission path. In this case, threshold values may be set only with respect to, e.g., plural blocks to implement the above-mentioned processing only with respect to the blocks in which the threshold values are set.

On the other hand, the minimum normalization coefficient detecting circuit 52 detects minimum one of normalization coefficients of respective units in a block or blocks where the required number of bits is above threshold to deliver the detected result as data x06 along with data x05 to the normalization coefficient modification circuit 50.

The normalization coefficient modification circuit 50 allows a value obtained by adding 1 only to the detected minimum normalization coefficient to be a new normalization coefficient to send new normalization coefficients of respective units as data x07 along with spectrum data to the spectrum data re-quantizing circuit 47. Then, the spectrum data re-quantizing circuit 47 carries out, for a second time, normalization, etc., of spectrum data as described above by using new normalization coefficients.

Then, this signal encoding apparatus repeats the above-described procedure until the number of bits required for entropy encoding is below a threshold set in advance. As a result, data x08 consisting of entropy-encoded spectrum data, normalization coefficients of respective units, the numbers of requantization bits and division information of the unit is ultimately outputted from the bit No. judging circuit 51.

Meanwhile, in the above-described embodiment, spectrum data is generated by MDCT, but there may be employed an approach to implement filtering to an input signal, e.g., by digital filter of the definite order to consider spectrum data to be signals on the time base in place of signals on the frequency base to carry out entropy encoding.

Figure 4:
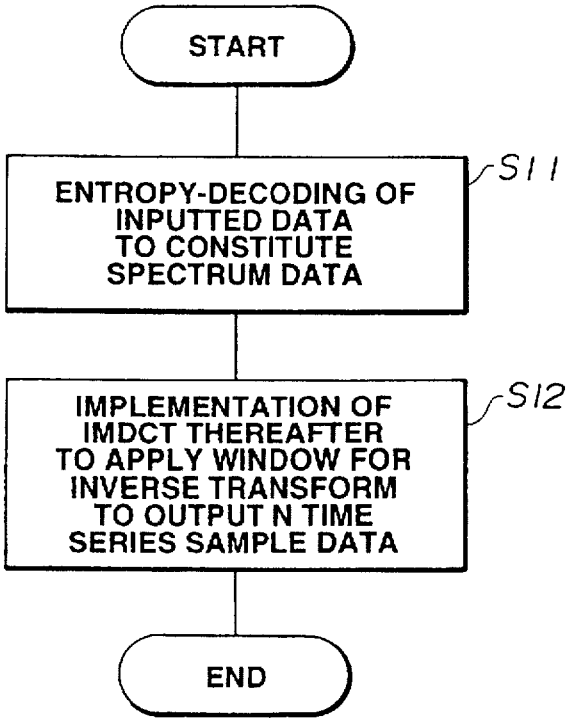
FIG. 4 is a flowchart of an embodiment of a signal decoding method according to this invention.

The flowchart of FIG. 4 shows outline of the procedure of signal decoding in the embodiment of the signal decoding method of this invention for decoding signals encoded in a manner as described above.

Namely, the signal decoding method of this embodiment is adapted to decode signals encoded by the signal encoding method or the signal encoding apparatus described above.

At step S11 shown in FIG. 4, e.g., input data delivered directly or through transmission path from a signal encoding apparatus, or input data reproduced from the above-described recording medium is caused to undergo entropy-decoding by using division information of unit, etc., to reproduce spectrum data.

At step S12, IMDCT is implemented to these spectrum data thereafter to apply window for inverse transform processing thereto to reproduce N number of time series sample data to output reproduced data. Thus, the processing is completed.

Figure 5:
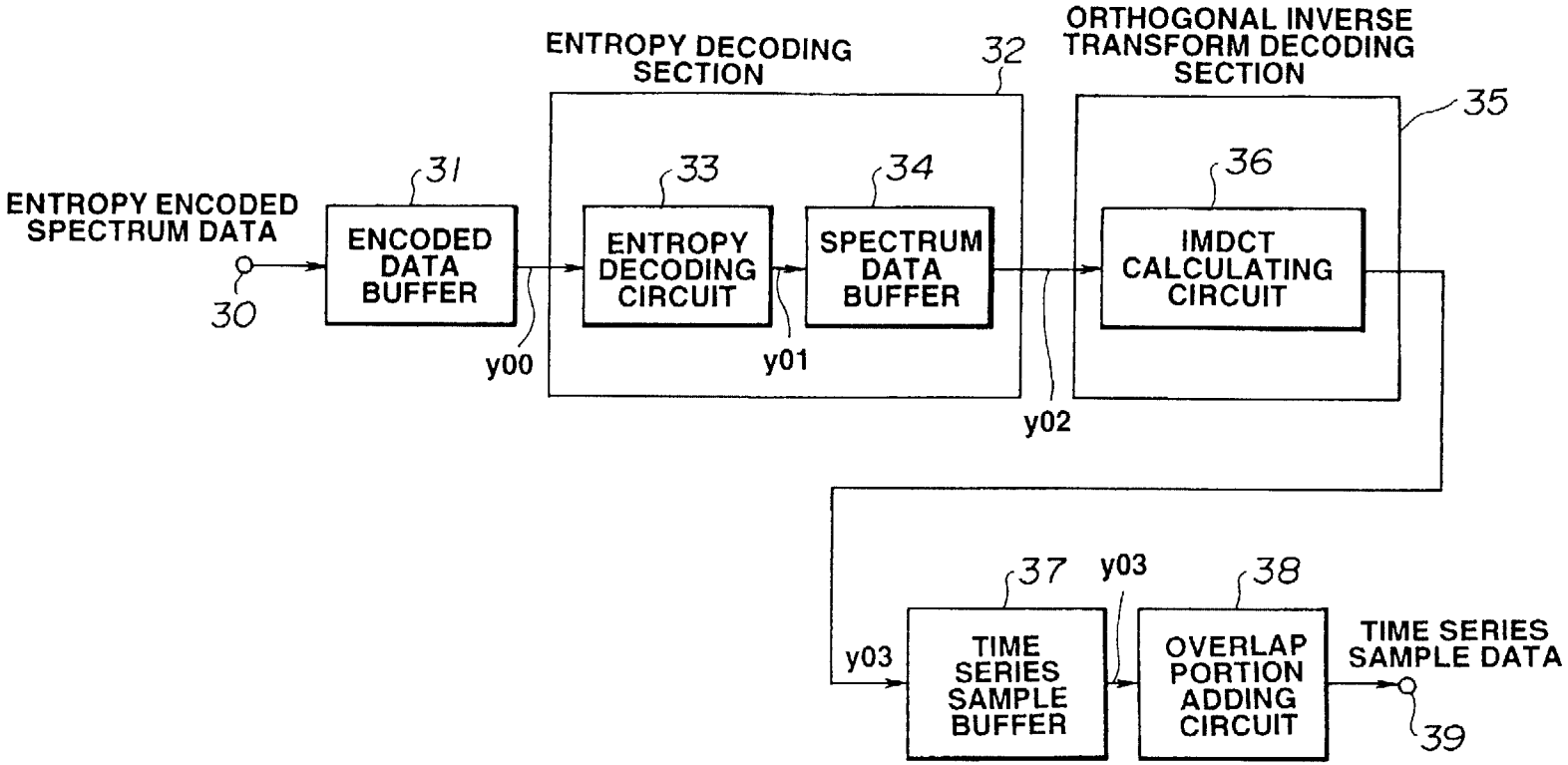
FIG. 5 is a block circuit diagram showing an embodiment of a signal decoding apparatus according to this invention.

Hardware for realizing the above-described decoding method, i.e., an example of the configuration of a signal decoding apparatus to which this invention is applied is shown in FIG. 5.

The signal decoding apparatus to which this invention is applied comprises, as shown in FIG. 5, an encoded data buffer 31 for storing input data, an entropy decoding section 32 for entropy-decoding input data which has been read out from the encoded data buffer 31, an orthogonal inverse transform decoding section 35 for implementing IMDCT to spectrum data from the entropy-decoding section 32 to reproduce time series sample data, a time series sample buffer 37 for storing time series sample data from the orthogonal inverse transform decoding section 35, and an overlap portion adding circuit 38.

Input data which has been transmitted directly or through a communication equipment from a signal encoding apparatus, or input data reproduced after undergoing recording onto recording media (package media, etc.), i.e., entropy-encoded spectrum data is delivered to the encoded data buffer 31 through input terminal 30. The entropy-encoded spectrum data is stored into the encoded data buffer 31, and is then read out therefrom. The data thus read out is delivered to the entropy decoding section 32 as data y00.

The entropy decoding section 32 comprises, as shown in FIG. 5, an entropy decoding circuit 33 for entropy-decoding data y00 from the encoded data buffer 31, and a spectrum data buffer 34 for storing spectrum data from the entropy decoding circuit 33.

The entropy decoding circuit 33 entropy-decodes data y00 read out from the encoded data buffer 31, i.e., entropy-encoded spectrum data by using an inverse code table corresponding to the code table which was used in entropy-encoding to reproduce spectrum data to deliver the spectrum data as data y01 to the spectrum data buffer 34.

The spectrum data buffer 34 once (temporarily) stores this data y01 thereafter to read out it in units of unit to deliver it as data y02 to the orthogonal inverse transform decoding section 35.

The orthogonal inverse transform decoding section 35 comprises, as shown in FIG. 5, an IMDCT calculating circuit 36 for carrying out IMDCT. The IMDCT calculating circuit 36 inverse-quantizes data y02, i.e., N/2 number of spectrum data delivered from the spectrum data buffer 34 by using normalization coefficients and numbers of re-quantization bits of every unit sent along with the entropy-encoded spectrum data thereafter to implement IMDCT thereto to further apply window for inverse transform processing thereto to reproduce time series sample data to deliver the time series sample data as data y03 to the time series sample buffer 37.

The time series sample buffer 37 once (temporarily) stores data y03 thereafter to read it out in block units to deliver it to the overlap portion adding circuit 38.

The overlap portion adding circuit 38 carries out additive processing of data y03 read out from the time series sample buffer 36, i.e., N number of time series sample data per each block and time series sample data of blocks adjoining in both directions to reproduce (restore) original time series sample data to output the time series sample data through output terminal 39.

A more practical example of an efficient encoding apparatus using the above-described signal encoding apparatus will now be described with reference to FIG. 6.

Figure 6:
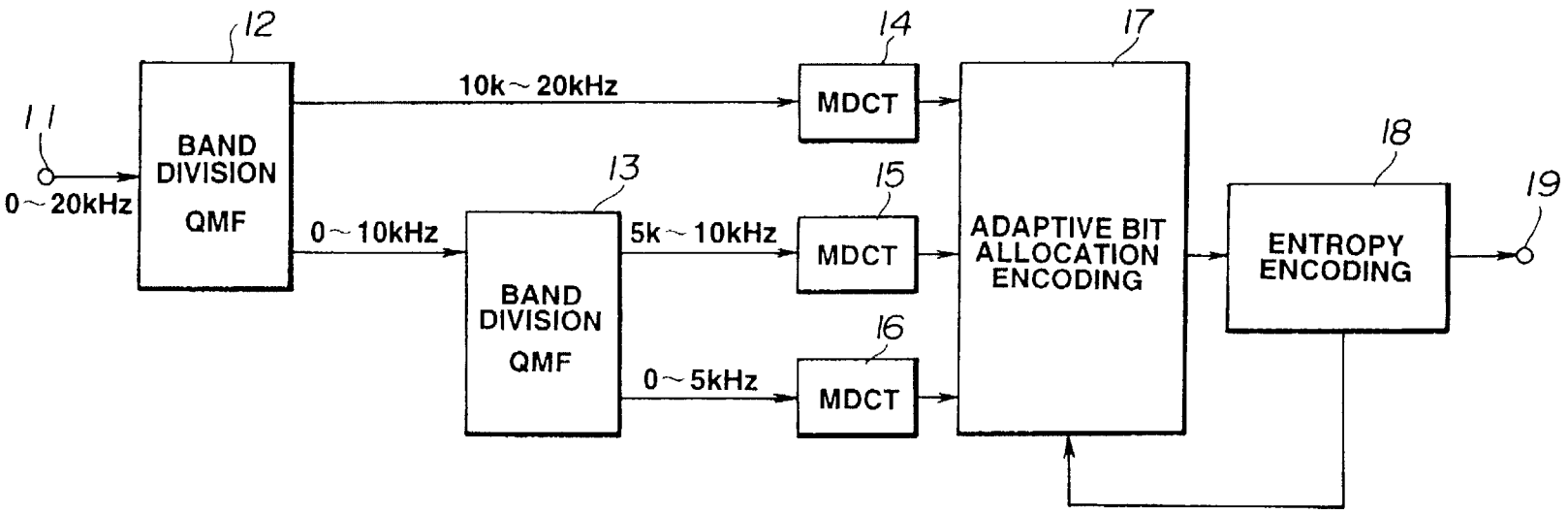
FIG. 6 is a block circuit diagram showing an actual configuration of an efficient encoding apparatus to which this invention is applied.

The more practical efficient encoding apparatus shown in FIG. 6 uses respective technologies of band division encoding, adaptive transform encoding, and adaptive bit allocation.

Namely, the efficient encoding apparatus shown in FIG. 6 divides a digital signal such as a PCM audio signal, etc., inputted through input terminal 11 into signals in plural frequency bands, and makes a selection such that according to frequency shifts to higher frequency band side, frequency bandwidths become broader to carry out, for every frequency bands, MDCT which is orthogonal transform processing to adaptively allocate, for every so called critical bands, bits to the spectrum data on the frequency base thus obtained to encode those data.

In actual terms, in FIG. 6, e.g., an audio PCM signal of 0~20 kHz is delivered to a band division filter 12 through the input terminal 11. The band division filter 12 is comprised of a filter such as QMF, etc., and serves to divide the audio PCM signal of 0~20 kHz band into a signal of 0~10 kHz band and a signal of 10 k~20 kHz band to deliver the signal of the 0~10 kHz band to a band division filter 13, and to deliver the signal of the 10 k~20 kHz band to a MDCT circuit 14.

The band division filter 13 is comprised of, e.g., QMF, etc., similarly to the band division filter 12, and serves to divide the audio PCM signal of 0~10 kHz band into a signal of 0~5 kHz band and a signal of 5 k~10 kHz band to deliver the signal of 5 k~10 kHz band to a MDCT circuit 15, and to deliver the signal of 0~5 kHz band to a MDCT circuit 16.

The MDCT circuits 14~16 implements MDCT to the signal of the 10 k~20 kHz band, the signal of the 5 k~10 kHz band, and the signal of the 0~5 kHz band delivered from band division filters 12, 13, and combines, every critical bands, spectrum data or coefficient data on the frequency base thus obtained to deliver the data thus combined to an adaptive bit allocation encoding circuit 17. Here, the critical bands are frequency bands divided by taking the hearing sense characteristic into consideration, and are defined as bands that narrow band noises having the same intensity in the vicinity of a frequency of a pure sound when the pure sound is masked by those noises. For example, the critical bands are such that according to frequency shifts to higher frequency band side, bandwidths become broader, and the entire frequency band of 0~20 kHz is divided into 25 critical bands.

The adaptive bit allocation encoding circuit 17 normalizes respective spectrum signals included in the critical bands by using normalization coefficients, e.g., maximum values of the absolute values of spectrum signals included in the critical bands, and re-quantizes the normalized spectrum signals by the number of bits sufficient so that quantizing noises are masked by signals of critical bands. Then, the adaptive bit allocation encoding circuit 17 delivers the re-quantized spectrum signals to the entropy encoding circuit 18 along with normalization coefficients used for every respective critical band and the number of bits used in re-quantization.

The entropy encoding circuit 18 encodes the re-quantized spectrum signals from the adaptive bit allocation encoding circuit 17 by entropy encoding, e.g., block Huffmann encoding, etc., and judges whether or not the number of bits having undergone entropy encoding is within a predetermined number of bits. As a result, when the number of bits is not within the predetermined number of bits, the entropy encoding circuit 18 controls the adaptive bit allocation encoding circuit 17 so as to vary normalization coefficient of at least one critical band to carry out re-quantization.

Thus, until the number of bits having undergone entropy encoding is within the predetermined number of bits, the above-described processing, i.e., processing at the adaptive bit allocation encoding circuit 17 and the entropy encoding circuit 18 will be repeated. When the number of bits having undergone entropy encoding is within the predetermined number of bits, an entropy-encoded spectrum signal is outputted through output terminal 19. The encoded signal thus obtained from the output terminal 19 is recorded onto a recording medium, e.g., magneto-optical disc, magnetic disc or magnetic tape, etc.

It is to be noted that, similarly to the above-described embodiment of the signal encoding apparatus, entropy-encoding of spectrum signals may be carried out, e.g., for every respective band, or may be implemented only to a portion of spectrum signals. Moreover, in entropy-encoding, there may be employed an approach to divide spectrum signals of respective critical bands (blocks) into several units to normalize spectrum signals every respective units thereafter to entropy-encode those signals. Employment of such an approach permits operation of higher accuracy by the same operation word length. Further, division of bands of respective critical bands or units may be changed in dependency upon the property of an input signal.

The embodiment of the recording medium according to this invention will now be described. The recording medium of this embodiment is adapted so that signals encoded by the signal encoding method or the signal encoding apparatus described above are recorded therein. Namely, there are recorded entropy-encoded spectrum signals obtained by blocking an input signal to transform the blocked signals into spectrum signals to divide the spectrum signals into a plurality of units to normalize them, and to entropy-encode all or a portion of the spectrum signals, wherein an upper limit is provided with respect to the number of bits per each block of the entropy-encoded spectrum signal to compulsorily change, in a block for which the number of bits above the upper limit is required, normalization coefficient of at least one unit thereafter to re-quantize and entropy-encode spectrum signals. As the recording medium, there can be several recording media, e.g., magnetic tape, optical disc, magneto-optical disc, phase change type optical disc, semiconductor memory, and so called IC card, etc.

An actual example of an efficient decoding apparatus using the above-described signal decoding apparatus will now be described with reference to FIG. 7.

Figure 7:
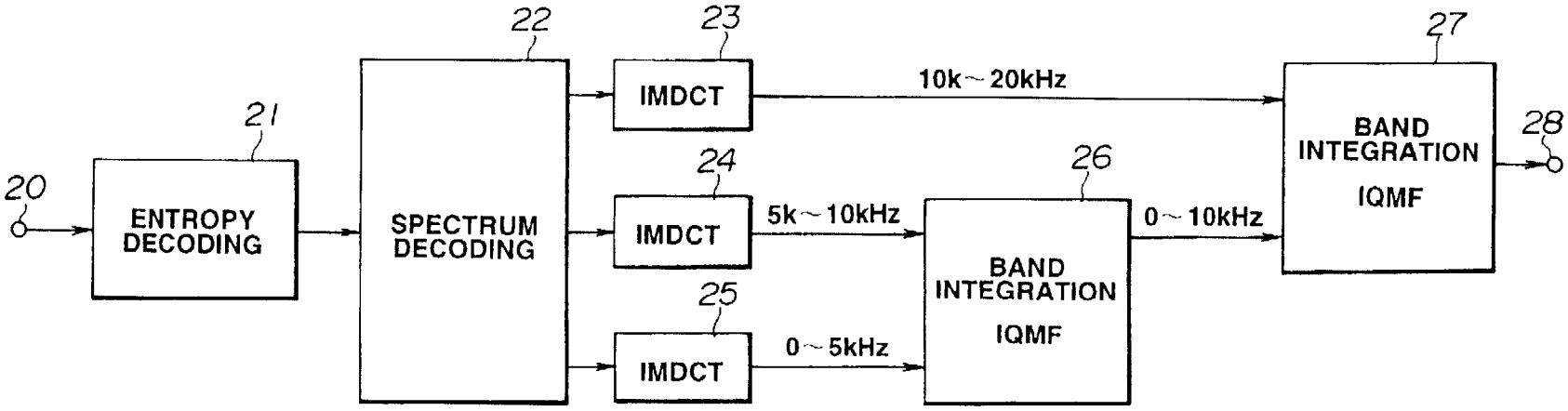
FIG. 7 is a block circuit diagram showing an actual configuration of an efficient code decoding apparatus to which this invention is applied.

In FIG. 7, entropy-encoded spectrum signal is inputted to an entropy decoding circuit 21 through input terminal 20 along with normalization coefficient and the number of bits used in re-quantization. The entropy decoding circuit 21 entropy-decodes the entropy-encoded spectrum signal in correspondence with entropy encoding of the above-described efficient decoding apparatus to reproduce re-quantized spectrum signal to deliver the spectrum signal to a spectrum decoding circuit 22.

The spectrum decoding circuit 22 inverse-quantizes the re-quantized spectrum signal from the entropy decoding circuit 21 by using normalization coefficient and the number of re-quantization bits, etc., to reproduce spectrum signals. Then, the spectrum decoding circuit 22 delivers a spectrum signal of 10 k~20 kHz band of the reproduced spectrum signals to an IMDCT circuit 23, delivers a spectrum signal of the 5 k~10 kHz band to an IMDCT circuit 24, and delivers a spectrum signal of 0~5 kHz band to an IMDCT circuit 25.

The IMDCT circuits 23~25 implement IMDCT to the spectrum signals of the bands to reproduce, for every respective band, signal waveform data indicating, e.g., waveforms of signals on the time base, respectively. Then, the IMDCT circuit 23 delivers signal waveform data of the 10 k~20 kHz band to a band integration (synthesis) circuit 27, the IMDCT circuit 24 delivers signal waveform data of the 5 k~10 kHz band to a band integration (synthesis) circuit 26, and the IMDCT circuit 25 delivers signal waveform data of the 0~5 kHz to a band integration (synthesis) circuit 26.

The band integration circuit 26 synthesizes the signal waveform data of the 0~5 kHz band and the signal waveform data of the 5 k~10 kHz band to deliver the signal waveform data of 0~10 kHz band thus obtained to the band integration circuit 27.

The band integration circuit 27 synthesizes signal waveform data of the 0~10 kHz band from the band integration circuit 26 and signal waveform data of the 10 k~20 kHz band from the IMDCT circuit 23 to reproduce signal waveform data of the 0~20 kHz band to output the signal waveform data through output terminal 28.

As stated above, in the above-described embodiment, an upper limit of the number of bits having undergone entropy-encoding is determined with respect to respective blocks of an input signal, e.g., PCM audio signal, etc. to adjust, in a block for which the number of bits above the upper limit is required, normalization coefficients of respective units to thereby fix the upper limit of the required number of bits, thus making it possible to carry out encoding processing at a fixed bit rate. In addition, also at a variable bit rate, scale of hardware can be held down to a predetermined scale.

Moreover, in the above-described embodiments, an operation to extract, as a tone characteristic component, adjacent several spectrum signals with energy concentration of spectrum signals of respective blocks to allow respective spectrum signals to be units, and to allow spectrum signals except for the above to be noise characteristic components to divide those components every bands set in advance to allow divided signal components to be unit to compulsorily allow normalization coefficients of respective units to be large, in a block for which the number of bits above the upper limit is required, in the reverse order of magnitude of normalization only with respect to, e.g., units of noise characteristic components, and in the order from the side of higher frequency in the case of the same normalization coefficient is repeated until the number of bits does not exceed the upper limit, thereby making it possible to reduce influence from a viewpoint of the hearing sense.

Further, in noise characteristic components where energies do not concentrate, those components frequently take 0 as spectrum data particularly after having undergone re-quantization, and relatively short codes are allocated to 0 of spectrum data in the entropy encoding. Accordingly, in the above-described embodiments, normalization coefficients are caused to be compulsorily larger, whereby several spectrum data which did not take 0 until before become equal to zero, thus making it possible to express spectrum data by lesser number of bits. Namely, by a procedure as described above, necessary number of bits can be reduced in a form such that influence from a viewpoint of the hearing sense is small.

Furthermore, in the above-described embodiments, setting of the upper limit of the number of bits is carried out in plural block units of time series sample data, or a plurality of code tables is prepared in the entropy encoding to select, for every respective block, a code table in which required number of bits is minimum, thus making it possible to carry out encoding of higher compression efficiency. In addition, plural other methods may be combined.

It should be noted that this invention is not limited only to the above-described embodiments, e.g., apparatuses to which this invention is applied are not limited to the above-described efficient encoding apparatus and efficient decoding apparatus shown in FIGS. 6 and 7, but may be applied to various transform encoding apparatuses or decoding apparatuses for releasing encoding, or the like.

As is clear from the foregoing description, this invention has a scheme to block an input signal (divide an input signal into blocks) to transform blocked signals into spectrum signals to divide these spectrum signals into a plurality of units to normalize them thereafter to implement variable length encoding to all or a portion of the spectrum signals to output the variable length encoded signals along with normalization coefficients and the numbers of requantization bits of respective units, wherein an upper limit is provided with respect to the number of bits per each block of a signal to be encoded and outputted to compulsorily change, in a block for which the number of bits above the upper limit is required, normalization coefficient of at least one unit thereafter to re-quantize and entropy-encode spectrum signals to output the encoded spectrum signals to thereby permit scale of hardware to be smaller as compared to the conventional apparatus without depending upon unevenness of the number of bits by variable length encoding. In addition, efficient encoding and decoding can be carried out in a form such that influence from a viewpoint of the hearing sense is small.

What is claimed is:

1. A signal encoding method comprising:

blocking an input signal to transform the blocked signals into spectrum signals;

dividing the spectrum signals into a plurality of units to normalize every respective unit of the spectrum signals;

implementing variable length encoding to all or a portion of the spectrum signals; and outputting the variable length encoded signal along with normalization coefficient and the number of re-quantization bits of each of the units;

wherein an upper limit is provided with respect to the number of bits per each block of the signal to be encoded and outputted; and further wherein, in a block for which the number of bits above the upper limit is required, normalization of at least one unit is compulsorily changed thereafter to re-quantize and entropy-encode a corresponding spectrum signal thus to output the spectrum signal thus encoded.

2. A signal encoding method as set forth in claim 1, wherein, in dividing spectrum signals into units within a corresponding one of the respective blocks, the number of units within each of the blocks and the number of spectrum signals within each of the units are changed in dependency upon the shape of the spectrum signals of the corresponding block.

3. A signal encoding method as set forth in claim 2, wherein, in dividing spectrum signals into units within a corresponding one of the respective blocks, the spectrum signals are separated into spectrum signals of tone characteristic and spectrum signals of noise characteristic, and the spectrum signals of the tone characteristic and the spectrum signals of the noise characteristic are divided into a different single or plural units, and information indicative of division of the corresponding unit is outputted.

4. A signal encoding method as set forth in claim 1, wherein, in a block for which the number of bits above the upper limit is required, selection of the unit in which the normalization coefficient is changed is carried out in dependency upon the shape of the spectrum signals of the block.

5. A signal encoding method as set forth in claim 4, wherein, in a block for which the number of bits above the upper limit is required, the normalization coefficient of at least one unit is caused to be larger.

6. A signal encoding method as set forth in claim 4, wherein, in a block for which the number of bits above the upper limit is required, selection is made in the order from units in which the normalization coefficient is small to allow normalization coefficient of the selected unit to be larger.

7. A signal encoding method as set forth in claim 4, wherein, in a block for which the number of bits above the upper limit is required, selection of units in which the normalization coefficient is caused to be larger is carried out in the order from units of higher frequency band side of all spectrum signals.

8. A signal encoding method as set forth in claim 4, wherein, in a block for which the number of bits above the upper limit is required, normalization coefficient or coefficients of a portion of the units is or are not caused to be changed, and selection is made in the order from units in which normalization coefficient is small of the remaining units to allow normalization coefficient of the selected unit to be larger.

9. A signal encoding method as set forth in claim 8, wherein in a block for which the number of bits above the upper limit is required, normalization coefficients of units of spectrum signals of tone characteristic are not caused to be changed, and selection is made in order from units in which normalization coefficient is small of the remaining units to allow normalization coefficient of the selected unit to be larger.

10. A signal encoding method as set forth in claim 1, wherein the input signal is divided into signals in a plurality of bands having respective bandwidths which are not uniform to carry out, for every respective band, transform processing into spectrum signals.

11. A signal encoding method as set forth in claim 1, wherein Modified Discrete Cosine Transform processing is used as transform processing from the input signal into spectrum signals.

12. A signal encoding method as set forth in claim 1, wherein a plurality of code tables of variable length codes used in the variable length encoding are prepared in correspondence with the number of bits of re-quantization, thus to carry out variable length encoding by using the plurality of code tables.

13. A signal encoding method as set forth in claim 1, the method comprising the steps of:

preparing a plurality of code tables of variable length codes used in the variable length encoding;

selecting a code table in which the number of bits necessary for encoding is minimum in each of the blocks;

carrying out variable length encoding by using the selected code table; and outputting an identification signal of the code table.

14. A signal encoding apparatus adapted for blocking an input signal to transform the blocked signals into spectrum signals to divide the spectrum signals into a plurality of units to normalize them to implement variable length encoding to all or a portion of the spectrum signals to output the variable length encoded signal along with normalization coefficient and the number of re-quantization bits of each of the units, the apparatus comprising:

upper limit setting means for providing an upper limit with respect to the number of bits per each block of the signal to be encoded and outputted; and normalization coefficient compulsorily changing means for detecting a block for which the number of bits above the upper limit is required to compulsorily change normalization coefficient of at least one unit of the detected block, to compulsorily change, by the normalization coefficient compulsorily changing means, normalization coefficient of at least one unit of the block for which the number of bits above the upper limit is required thereafter to re-quantize and entropy-encode a corresponding spectrum signal to output the spectrum signal thus encoded.

15. A signal encoding apparatus as set forth in claim 14, wherein, in dividing spectrum signals into units within a corresponding one of the respective blocks, the number of units within each of the blocks and the number of spectrum signals within each of the units change in dependency upon the shape of the spectrum signals of the corresponding block.

16. A signal encoding apparatus as set forth in claim 15, wherein, in dividing spectrum signals into units in each of the blocks, the spectrum signals are separated into spectrum signals of tone characteristic and spectrum signals of noise component, and the spectrum signals of the tone characteristic and the spectrum signals of the noise characteristic are divided into a different single or plural units to output information indicative of division of the unit.

17. A signal encoding apparatus as set forth in claim 14, wherein, in a block for which the number of bits above the upper limit is required, selection of the unit in which the normalization coefficient is changed is carried out in dependency upon the shape of the spectrum signals of the block.

18. A signal encoding apparatus as set forth in claim 17, wherein, in a block for which the number of bits above the upper limit is required, the normalization coefficient of at least one unit is caused to be larger.

19. A signal encoding apparatus as set forth in claim 17, wherein, in a block for which the number of bits above the upper limit is required, selection is made in the order from units in which the normalization coefficient is small to allow normalization coefficient of the selected unit to be larger.

20. A signal encoding apparatus as set forth in claim 17, wherein, in a block for which the number of bits above the upper limit is required, selection of unit in which the normalization coefficient is caused to be larger is carried out in the order from units of higher frequency band side of all spectrum signals.

21. A signal encoding apparatus as set forth in claim 17, wherein, in a block for which the number of bits above the upper limit is required, normalization coefficient or coefficients of a portion of units is or are not caused to be changed, and selection is made in the order from units in which normalization coefficient is small of the remaining units to allow normalization coefficient of the selected unit to be larger.

22. A signal encoding apparatus as set forth in claim 21, wherein, in a block for which the number of bits above the upper limit is required, normalization coefficients of unit of spectrum signals of tone characteristic are not caused to be changed, and selection is made in the order from units in which normalization coefficient is small of the remaining units to allow normalization coefficient of the selected unit to be larger.

23. A signal encoding apparatus as set forth in claim 14, wherein the input signal is divided into signals in a plurality of bands having respective bandwidths which are not uniform to carry out transform processing into spectrum signals for every respective band.

24. A signal encoding apparatus as set forth in claim 14, wherein Modified Discrete Cosine Transform processing is used as transform processing from the input signal into spectrum signals.

25. A signal encoding apparatus as set forth in claim 14, wherein a plurality of code tables of variable length codes used in the variable length encoding are prepared in correspondence with the number of bits of re-quantization to carry out variable length encoding by using the plurality of code tables.

26. A signal encoding apparatus as set forth in claim 14, wherein the apparatus includes a plurality of code tables of variable length codes used in the variable length encoding, to select a code table in which the number of bits necessary for encoding is minimum in each of the blocks to carry out variable length encoding by using the selected code table, and to output an identification signal of the code table.

27. A signal decoding method for decoding a signal obtained by blocking an input signal to transform the blocked signals into spectrum signals to divide the spectrum signals into a plurality of units to normalize them to implement variable length encoding to all or a portion of the spectrum signals, wherein an upper limit is provided with respect to the number of bits per each block of an encoded signal to compulsorily change, in a block for which the number of bits above the upper limit is required, normalization coefficient of at least one unit thereafter to re-quantize and entropy-encode a corresponding spectrum signal, the signal being outputted along with normalization coefficient and the number of re-quantization bits of each of the units.

28. A signal decoding method as set forth in claim 27, wherein the signal decoding method comprises decoding an encoded signal in which, in dividing spectrum signals into units in a corresponding one of the respective blocks, the number of units of each of the blocks and the number of spectrum signals within each of the units are changed in dependency upon the shape of the spectrum signals of the corresponding block.

29. A signal decoding method as set forth in claim 28, wherein the signal decoding method further comprises decoding a signal obtained through an operation such that, in dividing spectrum signals into units in each of the blocks, the spectrum signals are separated into spectrum signals of tone characteristic and spectrum signals of noise characteristic to divide the spectrum signals of the tone characteristic and the spectrum signals of the noise characteristic into a different single or plural units, and the signal is outputted along with information indicative of division of the unit.

30. A signal decoding method as set forth in claim 27, wherein the signal decoding method comprises: decoding an encoded signal in which, in a block for which the number of bits above the upper limit is required, selection of the unit in which the normalization coefficient is changed is carried out in dependency upon the shape of the spectrum signals of the block.

31. A signal decoding method as set forth in claim 30, wherein the signal decoding method further comprises decoding a signal encoded through an operation such that, in a block for which the number of bits above the upper limit is required, the normalization coefficient of at least one unit is caused to be larger.

32. A signal decoding method as set forth in claim 30, wherein the signal decoding method further comprises decoding a signal encoded through an operation such that, in a block for which the number of bits above the upper limit is required, selection is made in the order from units in which the normalization coefficient is small to allow the normalization coefficient of the selected unit to be larger.

33. A signal decoding method as set forth in claim 30, wherein the signal decoding method further comprises decoding a signal encoded through an operation such that, in a block for which the number of bits above the upper limit is required, selection of unit in which the normalization coefficient is caused to be larger is carried out in the order from units of higher frequency band side of all spectrum signals.

34. A signal decoding method as set forth in claim 30, wherein the signal decoding method further comprises decoding a signal encoded through an operation such that, in a block for which the number of bits above the upper limit is required, normalization coefficient or coefficients of a portion of units is or are not caused to be changed, and selection is made in the order from units in which normalization coefficient is small of the remaining units to allow the normalization coefficient of the selected unit to be larger.

35. A signal decoding method as set forth in claim 34, wherein the signal decoding method further comprises decoding a signal encoded through an operation such that, in a block for which the number of bits above the upper limit is required, normalization coefficients of units of spectrum signals of the tone characteristic are not caused to be changed, and selection is made in the order from units in which normalization coefficient is small of the remaining units to allow the normalization coefficient of the selected unit to be larger.

36. A signal decoding method as set forth in claim 27, wherein the signal decoding method further comprises decoding a signal encoded through an operation such that the input signal is divided into signals in plural bands having respective bandwidths which are not uniform, and transform processing into spectrum signals is carried out for every respective band.

37. A signal decoding method as set forth in claim 27, wherein the signal decoding method further comprises decoding a signal encoded through an operation in which Modified Discrete Cosine Transform processing is employed as transform processing from an input signal into spectrum signals.

38. A signal decoding method as set forth in claim 27, wherein the signal decoding method further comprises decoding a signal obtained through an operation such that a plurality of code tables of variable length codes used in the variable length encoding are prepared in dependency upon the number of bits of re-quantization to carry out variable length encoding by using the plurality of code tables.

39. A signal decoding method as set forth in claim 27, wherein the signal decoding method further comprises decoding a signal encoded through an operation such that a plurality of code tales of variable length codes used in the variable length encoding are prepared to select a code table in which the number of bits necessary for encoding is minimum in each of the blocks to carry out variable length encoding by using the selected code table, and to output the variable length encoded signal along with an identification signal of the code table.

40. A signal decoding apparatus including decoding means for decoding a signal obtained by blocking an input signal to transform the blocked signals into spectrum signals to divide the spectrum signals into a plurality of units to normalize them to implement variable length encoding to all or a portion of the spectrum signals, wherein an upper limit is provided with respect to the number of bits per each block of an encoded signal to compulsorily change, in a block for which the number of bits above the upper limit is required, normalization coefficient of at least one unit thereafter to re-quantize and entropy-encoded a corresponding signal, the signal being outputted along with normalization coefficient and the number of re-quantization bits of each of the units.

41. A signal decoding apparatus as set forth in claim 40, wherein the signal decoding apparatus decodes an encoded signal in which, in dividing spectrum signals into units within a corresponding one of the respective blocks, the number of units within each of the blocks and the number of spectrum signals within each of the units are changed in dependency upon the shape of the spectrum signals of the corresponding block.

42. A signal decoding apparatus as set forth in claim 41, wherein the signal decoding apparatus decodes a signal obtained through an operation such that, in dividing spectrum signals into units in each of the blocks, the spectrum signals are separated into spectrum signals of tone characteristic and spectrum signals of noise characteristic to divide the spectrum signals of the tone characteristic and the spectrum signals of the noise characteristic into a different single or plural units, and to output a corresponding signal along with information indicative of division of the unit.

43. A signal decoding apparatus as set forth in claim 40, wherein the signal decoding apparatus decodes an encoded signal in which, in a block for which the number of bits above the upper limit is required, selection of the unit in which the normalization coefficient is caused to be changed is carried out in dependency upon the shape of the spectrum signals of the block.

44. A signal decoding apparatus as set forth in claim 43, wherein the signal decoding apparatus decodes a signal encoded through an operation such that, in a block for which the number of bits above the upper limit is required, the normalization coefficient of at least one unit is caused to be larger.

45. A signal decoding apparatus as set forth in claim 43, wherein the signal decoding apparatus decodes a signal encoded through an operation such that, in a block for which the number of bits above the upper limit is required, selection is made in the order from units in which the normalization coefficient of the selected unit is small to allow the normalization coefficient of the selected unit to be larger.

46. A signal decoding apparatus as set forth in claim 43, wherein the signal decoding apparatus decodes a signal encoded through an operation such that, in a block for which the number of bits above the upper limit is required, selection of unit in which the normalization coefficient is caused to be larger is carried out in the order from units of higher frequency band of all spectrum signals.

47. A signal decoding apparatus as set forth in claim 43, wherein the signal decoding apparatus decodes a signal encoded through an operation such that, in a block for which the number of bits above the upper limit is required, normalization coefficient or coefficients of a portion of units is or are not caused to be changed to make selection in the order from units in which normalization coefficient is small of the remaining units to allow the normalization coefficient of the selected unit to be larger.

48. A signal decoding apparatus as set forth in claim 47, wherein the signal decoding apparatus decodes a signal encoded through an operation such that, in a block for which the number of bits above the upper limit is required, normalization coefficients of units of the spectrum signals of tone characteristic are not caused to be changed to make a selection in the order from units in which normalization coefficient is small of the remaining units to allow the normalization coefficient of the selected unit to be larger.

49. A signal decoding apparatus as set forth in claim 40, wherein the signal decoding apparatus decodes a signal encoded through an operation such that the input signal is divided into signals in a plurality of bands having respective bandwidths which are not uniform, and transform processing into spectrum signals is carried out for every respective band.

50. A signal decoding apparatus as set forth in claim 40, wherein the signal decoding apparatus decodes a signal encoded through an operation in which Modified Discrete Cosine Transform processing is used as the transform processing from an input signal into spectrum signals.

51. A signal decoding apparatus as set forth in claim 40, wherein the signal decoding apparatus decodes a signal obtained through an operation such that a plurality of code tables of variable length codes used in the variable length encoding are prepared in correspondence with the number of bits of re-quantization to implement variable length encoding to a corresponding signal by using the plurality of code tables.

52. A signal decoding apparatus as set forth in claim 40, wherein the signal decoding apparatus decodes a signal obtained through an operation such that a plurality of code tables of variable length codes used in the variable length encoding are prepared to select a code table in which the number of bits necessary for encoding becomes minimum in each of the blocks to carry out variable length encoding by using the selected code table, and to output a corresponding signal along with an identification signal of the code table.

53. A recording medium adapted so that there are recorded, therein, signals obtained by blocking an input signal to transform the blocked signals into spectrum signals to divide the spectrum signals into a plurality of units to normalize them to implement variable length encoding to all or a portion of the spectrum signals, wherein an upper limit is provided with respect to the number of bits per each block of an encoded signal to compulsorily change, in a block for which the number of bits above the upper limit is required, normalization coefficient of at least one unit thereafter to re-quantize and entropy-encode a corresponding signal, the signal being outputted along with normalization coefficient and the number of re-quantization bits of each of the units.

54. A recording medium as set forth in claim 53, wherein there are recorded therein encoded signals in which, in dividing spectrum signals into units within a corresponding one of the respective blocks, the number of units within each of the blocks and the number of spectrum signals within each of the units are changed in dependency upon the shape of the spectrum signals of the corresponding block.

55. A recording medium as set forth in claim 54, wherein there are recorded therein signals obtained through an operation such that, in dividing spectrum signals into units within a corresponding one of the respective blocks, the spectrum signals are separated into spectrum signals of tone characteristic and spectrum signals of noise characteristic to divide the spectrum signal of the tone characteristic and the spectrum signal of the noise characteristic into a different single or plural units, the signals being outputted along with information indicative of division of the unit.

56. A recording medium as set forth in claim 53, wherein there are recorded therein encoded signals in which, in a block for which the number of bits above the upper limit is required, selection of the unit in which the normalization coefficient is caused to be changed is carried out in dependency upon the shape of the spectrum signals of the block.

57. A recording medium as set forth in claim 56, wherein there are recorded therein signals encoded through an operation such that, in a block for which the number of bits above the upper limit is required, the normalization coefficient of at least one unit is caused to be larger.

58. A recording medium as set forth in claim 56, wherein there are recorded therein signals encoded through an operation such that, in a block for which the number of bits above the upper limit is required, selection is made in the order from units in which the normalization coefficient is small to allow the normalization coefficient of the selected unit to be larger.

59. A recording medium as set forth in claim 56, wherein there are recorded therein signals encoded through an operation such that, in a block for which the number of bits above the upper limit is required, selection of unit in which the normalization coefficient is caused to be larger is carried out in the order from units of higher frequency band side of all spectrum signals.

60. A recording medium as set forth in claim 56, wherein there are recorded therein signals encoded through an operation such that, in a block for which the number of bits above the upper limit is required, normalization coefficient or coefficients of a portion of units is or are not caused to be changed to make a selection in the order from units in which normalization coefficient is small of the remaining units to allow the normalization coefficient of the selected unit to be larger.

61. A recording medium as set forth in claim 60, wherein there are recorded therein signals encoded through an operation such that, in a block for which the number of bits above the upper limit is required, normalization coefficients of units of the spectrum signals of tone characteristic are not caused to be changed to make a selection in the order from units in which normalization coefficient is small of the remaining units to allow the normalization coefficient of the selected unit to be larger.

62. A recording medium as set forth in claim 53, wherein there are recorded therein signals encoded through an operation such that the input signal is divided into signals in a plurality of bands having respective bandwidths which are not uniform, and transform processing into spectrum signals is carried out for every respective band.

63. A recording medium as set forth in claim 53, wherein there are recorded therein signals encoded through an operation in which Modified Discrete Cosine Transform processing is used as the transform processing from an input signal into spectrum signals.

64. A recording medium as set forth in claim 53, wherein there are recorded therein signals obtained through an operation such that a plurality of code tables of variable length codes used in the variable length encoding are prepared in correspondence with the number of bits of re-quantization to carry out variable length encoding by using the plurality of code tables.

65. A recording medium as set forth in claim 53, wherein there are recorded therein signals obtained through an operation such that a plurality of code tables of variable length codes used in the variable length encoding are prepared to select a code table in which the number of bits necessary for encoding becomes minimum within each of the blocks to carry out variable length encoding by using the selected code table, the signals being outputted along with an identification signal of the code table.

* * * * *